US008257099B2

(12) United States Patent
Sainton et al.

(10) Patent No.: US 8,257,099 B2
(45) Date of Patent: Sep. 4, 2012

(54) SWITCH FOR UNIVERSAL SERIAL BUS

(75) Inventors: Joseph B. Sainton, Guangdong (CN); Joseph Shien Tang Tseng, Diamond Bar, CA (US)

(73) Assignee: Ever Win International Corporation, City of Industry, CA (US)

( * ) Notice: Subject to any disclaimer, the term of this patent is extended or adjusted under 35 U.S.C. 154(b) by 164 days.

(21) Appl. No.: 12/848,320

(22) Filed: Aug. 2, 2010

(65) Prior Publication Data

US 2012/0024678 A1 Feb. 2, 2012

(51) Int. Cl.
*H01R 29/00* (2006.01)

(52) U.S. Cl. ..... 439/188; 439/489; 200/51.06; 200/51.11

(58) Field of Classification Search ..... 200/51 R, 200/51.06, 51.11; 439/188, 489
See application file for complete search history.

(56) References Cited

U.S. PATENT DOCUMENTS

| | | | | |
|---|---|---|---|---|
| 5,800,192 | A | 9/1998 | David et al. | |
| 5,871,368 | A | 2/1999 | Erdner et al. | |
| 6,095,837 | A | 8/2000 | David et al. | |
| 6,162,078 | A | 12/2000 | Chung | |
| 6,281,457 | B1 * | 8/2001 | Chang | 200/547 |
| 7,121,873 | B2 | 10/2006 | Wu et al. | |
| 7,207,819 | B2 | 4/2007 | Chen | |
| 7,351,083 | B2 | 4/2008 | Biddle et al. | |
| 7,384,300 | B1 | 6/2008 | Salgado et al. | |
| 7,607,926 | B2 | 10/2009 | Wang | |
| 7,635,280 | B1 | 12/2009 | Crumlin et al. | |
| 7,895,384 | B2 * | 2/2011 | Matsui | 710/300 |
| 7,989,719 | B2 * | 8/2011 | Sun | 200/51 R |
| 2009/0186519 | A1 | 7/2009 | Chin et al. | |

* cited by examiner

*Primary Examiner* — Gary F. Paumen

(74) *Attorney, Agent, or Firm* — Joe Nieh

(57) ABSTRACT

A switch for universal serial bus is disclosed. The universal serial bus (USB) port has a built switch actuator that automatically turns power on and off upon insertion and removal of a USB plug. The switch for universal serial bus comprises of a USB port with a switch actuator in a power-off position and a momentary switch wherein when a USB plug is inserted into the USB port, the switch actuator is depressed which in turn depresses the momentary switch to turn on the power to the USB port. When the USB plug is removed from the USB port, the switch actuator returns to its original power-off position thereby turning off the power to the USB port.

8 Claims, 4 Drawing Sheets

SWITCH FOR UNIVERSAL SERIAL BUS

BACKGROUND-FIELD OF INVENTION

The present invention relates generally to universal serial bus. More specifically, the present invention relates to a switch design for universal serial bus.

BACKGROUND-DESCRIPTION OF RELATED ART

Universal serial bus (USB) is a specification created around 1996 to establish communication between electronic devices and a host controller. The host controller is usually a computer. USB can carry both power and data. It is intended to replace a variety of serial and parallel ports. USB is used to connect computer peripherals such as mice, keyboards, digital cameras, printers, flash drives, and external hard drives to a computer. It has become a common electronic interface for many modern electronic devices and computers.

The standard USB port has a rectangular opening with a plastic tongue that is enclosed in a metal sheath. There are four electrical contacts on the plastic tongue. The metal sheath has a locking tab on each narrow side and two locking tabs on the top and also on the bottom wider sides. The locking tabs are formed from cutouts in the metal sheath and are in the shape of elongated triangles. The short base of the elongated triangle remains affixed to the metal sheath, and the tip of the elongated triangle has a bend that extends into the USB port. The flexing of the elongated triangle bias the bend near the tip of the elongated triangle to exerts a retaining frictional force on the USB plug when it is inserted into the USB port. The tips of the elongated triangles at the narrow sides are oriented toward the rear of the USB port. The tips of the elongated triangles at the wider sides are oriented toward the front of the USB port. The standard USB plug has a compatible plug that can only plug into the USB port in one orientation.

The standard USB port in the prior art is a simple connector that has no control or switch to regulate the power supplied at the connector. Irrespective of whether a USB plug is inserted into the USB port, the standard USB port will have power at the connector. There is no switching means at the standard USB port to turn power on and off. A substantial amount of power is being consumed even when no USB plug is inserted in the USB port.

BRIEF SUMMARY OF THE INVENTION

The switch for universal serial bus of the present invention is a universal serial bus (USB) port with a built in switch to automatically turn power on and off upon insertion and removal of a USB plug. The switch for universal serial bus comprises of a USB port with a switch actuator in a power-off position and a momentary switch wherein when a USB plug is inserted into the USB port, the switch actuator is depressed which in turn depresses the momentary switch to turn on the power to the USB port. When the USB plug is removed from the USB port, the switch actuator returns to its original power-off position away from the momentary switch thereby turning off the power to the USB port.

An object of the switch for universal serial bus is to provide a USB port that consumes virtually no power when no USB plug is inserted. A further object of the switch for universal serial bus is to provide an automatic switch to turn power on and off at the USB port when a USB plug is inserted and removed. Another object of the switch for universal serial bus is to provide a low cost automatic switch at the USB port to minimize energy consumption when it is not being used.

DETAILED DESCRIPTION OF THE PREFERRED EMBODIMENT

Figure 2:
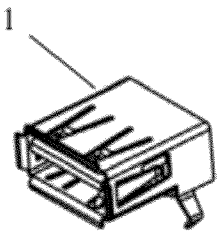
FIG. 2 shows another perspective view of the preferred embodiment of the switch for universal serial bus.

The following description and figures are meant to be illustrative only and not limiting. Other embodiments of this invention will be apparent to those of ordinary skill in the art in view of this description.

In the preferred embodiment shown in the figures, switch for universal serial bus comprises of a built in switch to automatically turn power on and off upon insertion and removal of a USB plug 4. The switch for universal serial bus comprises of a USB port 1 with a switch actuator 2 in a power-off position and a momentary switch 3 wherein when a USB plug 4 is inserted into the USB port 1, the switch actuator 2 is depressed which in turn depresses the momentary switch 3 to turn on the power to the USB port 1 as shown in FIGS. 8 through 12. When the USB plug 4 is removed from the USB port 1, the switch actuator 2 returns to its original power-off position away from the momentary switch 3 thereby turning off the power to the USB port 1.

Figure 1:
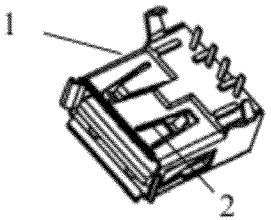
FIG. 1 shows a perspective view of the preferred embodiment of the switch for universal serial bus.
Figure 3:
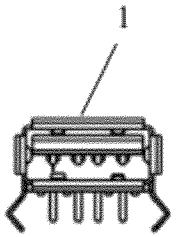
FIG. 3 shows the front view of the preferred embodiment of the switch for universal serial bus.
Figure 6:
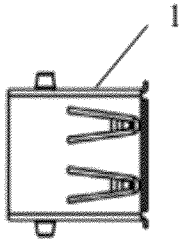
FIG. 6 shows the top view of the preferred embodiment of the switch for universal serial bus.
Figure 4:
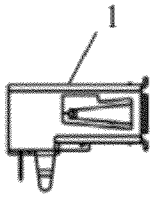
FIG. 4 shows the left side view of the preferred embodiment of the switch for universal serial bus.
Figure 7:
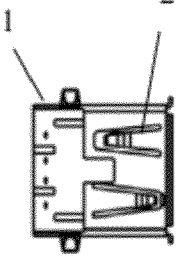
FIG. 7 shows the bottom view of the preferred embodiment of the switch for universal serial bus.
Figure 5:
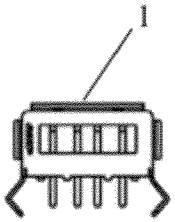
FIG. 5 shows the rear view of the preferred embodiment of the switch for universal serial bus.
Figure 9:
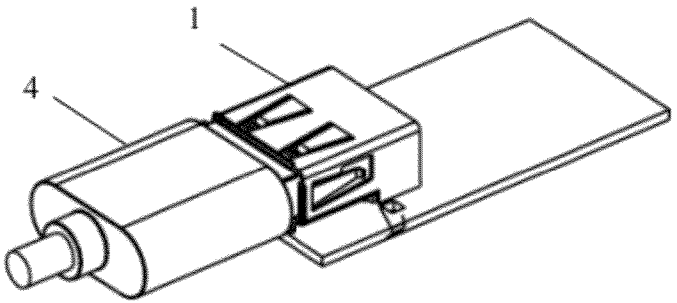
FIG. 9 shows a perspective view of an embodiment of the switch for universal serial bus after the universal serial bus plug is inserted.
Figure 8:
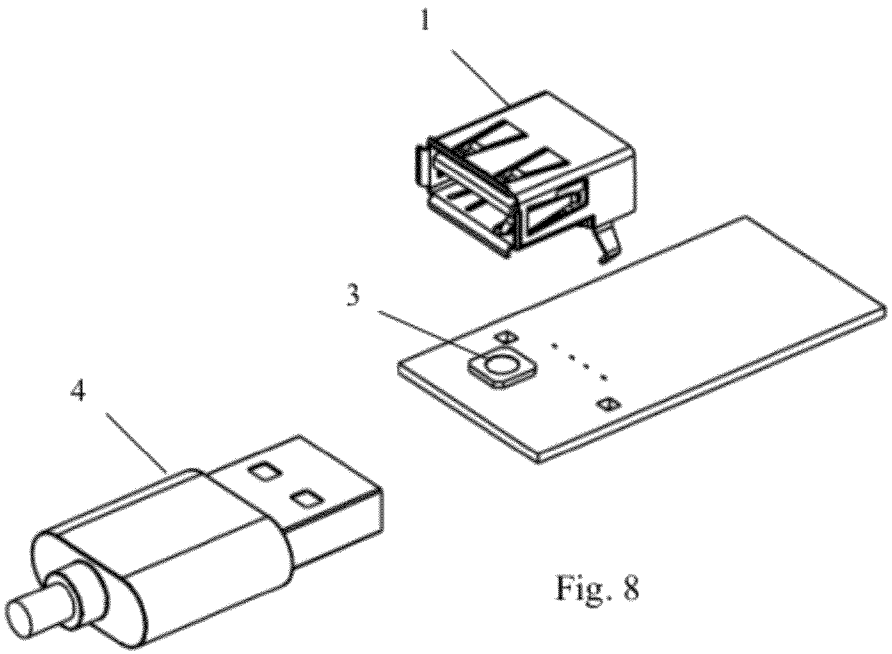
FIG. 8 shows a perspective view of an embodiment of the switch for universal serial bus before the universal serial bus plug is inserted.
Figure 10:
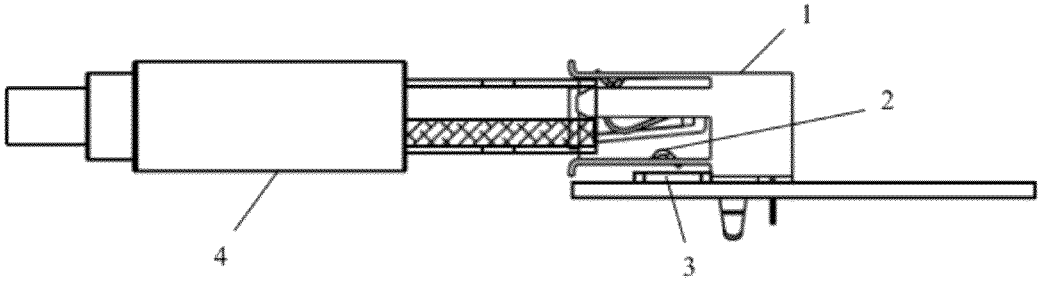
FIG. 10 shows a side view of an embodiment of the switch for universal serial bus before the universal serial bus plug is inserted.
Figure 11:
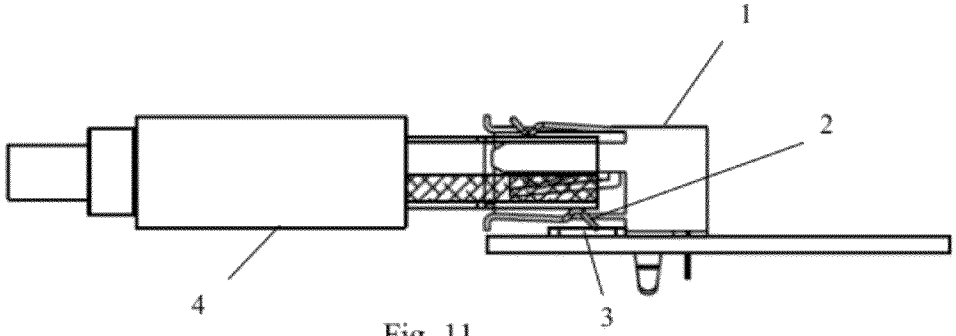
FIG. 11 shows a side view of an embodiment of the switch for universal serial bus during the insertion of the universal serial bus plug.
Figure 12:
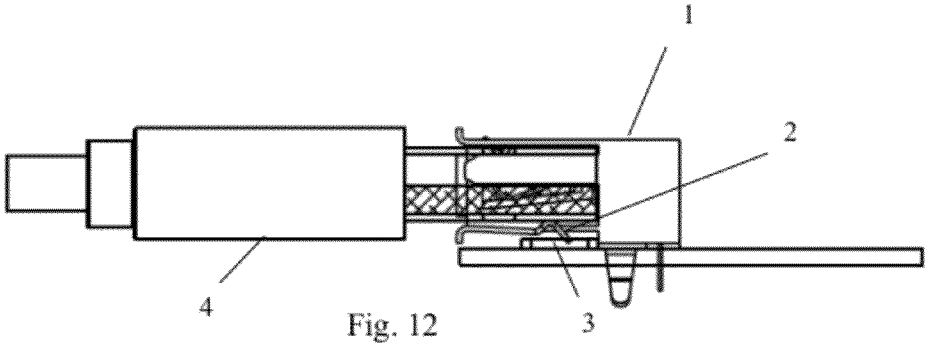
FIG. 12 shows a side view of an embodiment of the switch for universal serial bus after the universal serial bus plug is inserted.

In the preferred embodiment, the switch actuator 2 is an elongated tab generally in the shape of an elongated triangle as shown in FIGS. 1 and 7. One end of the elongated tab is flexibly affixed to the USB port 1. The other end of the elongated tab is free to flex into and out of the USB port 1. As shown in FIGS. 10 through 12, the free end of the elongated tab is formed such that a portion protrudes into the USB port 1 when no USB plug 4 is in the USB port 1 and a portion extends outside of the USB port 1 when a USB plug 4 is in the USB port 1. This can be accomplished by a "z" shaped bend at the free end of the elongated tab. The switch actuator 2 is preferably one of the locking tabs on the USB port's metal sheath. In one embodiment, the locking tab that is used as a switch actuator 2 is one of the two locking tabs on the bottom wide side of the USB port 1. The orientation of the locking tab that is used as the switch actuator 2 is opposite that of the other locking tab on the bottom wide side. This will position the free end of the switch actuator 2 away from where the USB plug 4 enters the USB port 1 thereby provide more space to position the momentary switch 3 under the free end.

As shown in FIGS. 8, 10, 11, and 12, a momentary switch 3 is positioned adjacent to the portion of the elongated tab that extends outside of the USB port 1 such that when the elongated tab is forced outward from the USB port 1, it will depress the momentary switch 3. The momentary switch 3 opens and closes a power circuit that powers the USB port 1.

As shown in FIGS. 10 through 12, when a USB plug 4 is inserted into the USB port 1, the USB plug 4 will force the switch actuator 2 to flex out of the USB port 1. The free end of the switch actuator 2 will then depress the momentary switch 3 to activate the power circuit. When the USB plug 4 is removed from the USB port 1, the switch actuator 2 returns to its original position with a portion protruding into the USB port 1. In this position, the pressure from the switch actuator 2 on the momentary switch 3 is removed. The momentary switch 3 then turns off the power circuit.

Figure 13:
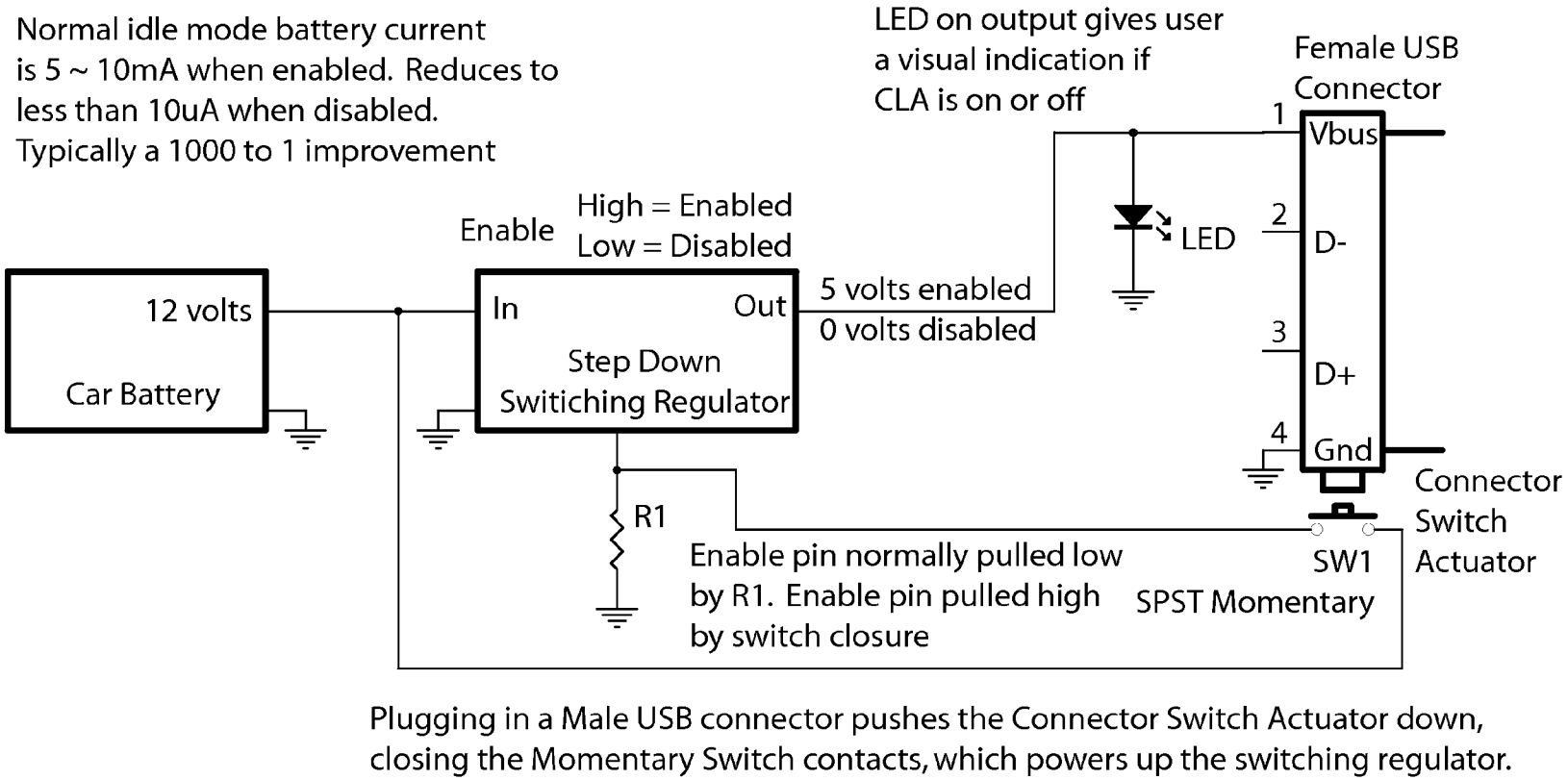
FIG. 13 shows a schematic diagram of an embodiment of the switch for universal serial bus in a vehicle power adapter.

One application of the switch for universal serial bus is shown in FIG. 13. In this embodiment, the switch for universal serial bus is embodied in a vehicle power adapter for recharging a mobile device such as a mobile phone with a car's 12V battery. Without a switch for universal serial bus, in the normal idle mode, the battery current is 5 to 10 mA. When the switch for universal serial bus is used, the battery current reduces to 10 μA. This is a very substantial 1000 to 1 reduction in energy use with the use of the current invention.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A switch for universal serial bus comprising:

a universal serial bus;

a switch actuator formed by part of said universal serial bus; and a momentary switch disposed outside of said universal serial bus adjacent said switch actuator;

whereby when said switch actuator is actuated by the insertion of a universal serial bus plug, said switch actuator is urged by said inserted universal serial bus plug to depresses said momentary switch.

2. A switch for universal serial bus as in claim 1 wherein said momentary switch activates a power circuit to turn on power to the universal serial bus when said universal serial bus plug is inserted into the universal serial bus.

3. A switch for universal serial bus as in claim 2 wherein when said universal serial bus plug is removed from the universal serial bus, said momentary switch turns off the power to the universal serial bus.

4. A switch for universal serial bus as in claim 1 wherein when said universal serial bus plug is removed from the universal serial bus, said switch actuator returns to a position away from the momentary switch.

5. A switch for universal serial bus as in claim 1 wherein said switch actuator is an elongated tab flexibly affixed to said universal serial bus.

6. A switch for universal serial bus as in claim 5 wherein said elongated tab has a free end that normally protrudes into an interior of the universal serial bus wherein when a universal serial bus plug is inserted into the interior of the universal serial bus, said free end flexes out of the interior of the universal serial bus and when said universal serial bus plug is removed from the interior of the universal serial bus, said free end flexes back into the interior of the universal serial bus.

7. A switch for universal serial bus as in claim 6 wherein said free end is directed away from an open end of said universal serial bus where said universal serial bus plug is inserted.

8. A switch for universal serial bus comprising:

a universal serial bus;

a switch actuator affixed to said universal serial bus wherein said switch actuator is an elongated tab flexibly affixed to said universal serial bus and has a free end that normally protrudes into an interior of the universal serial bus wherein when a universal serial bus plug is inserted into the interior of the universal serial bus, said free end flexes out of the interior of the universal serial bus and when said universal serial bus plug is removed from the interior of the universal serial bus, said free end flexes back into the interior of the universal serial bus; and a momentary switch disposed near said free end of said switch actuator wherein said momentary switch activates a power circuit to turn on power to the universal serial bus when a universal serial bus plug is inserted into the universal serial bus and when said universal serial bus plug is removed from the universal serial bus, said momentary switch turns off the power to the universal serial bus.

* * * * *